United States Patent [19]

Andreen

[11] Patent Number: 4,516,539

[45] Date of Patent: May 14, 1985

[54] INTERNAL COMBUSTION ENGINE

[76] Inventor: John F. Andreen, R.R. #3, Cadillac, Mich. 49601

[21] Appl. No.: 535,950

[22] Filed: Sep. 26, 1983

[51] Int. Cl.[3] ..... F02B 75/32

[52] U.S. Cl. ..... 123/53 R; 123/58 R; 123/71 R; 123/197 R; 123/90.67

[58] Field of Search ..... 123/54 R, 54 A, 54 B, 123/53 R, 53 B, 53 BA, 197 R, 71 R, 66, 74 R, 74 A, 90.67, 197 AB, 58 R

[56] References Cited

U.S. PATENT DOCUMENTS

| | | | |
|---|---|---|---|
| 988,650 | 4/1911 | Norris | 123/65 B |
| 1,257,104 | 2/1918 | Olson | 123/66 |
| 1,483,331 | 2/1924 | Burtnett | 123/53 B |
| 1,498,216 | 6/1924 | Wade | 123/50 R |
| 1,661,559 | 3/1928 | Burtnett | 123/53 B |
| 1,730,073 | 10/1929 | Heckman | 123/50 R |
| 2,083,808 | 6/1937 | Andrews | 123/50 R |
| 2,085,547 | 6/1937 | Schrom | 123/71 R |
| 2,129,172 | 9/1938 | Gehrandt | 123/51 B |
| 2,159,197 | 5/1939 | Barraja-Frauenfelder | 123/48 A |
| 2,184,820 | 12/1939 | Tucker | 123/51 B |
| 2,222,367 | 11/1940 | Keough | 123/66 |
| 2,611,350 | 9/1952 | Keough | 123/66 |
| 2,787,259 | 4/1957 | de Laage de Muex | 123/71 R |
| 2,899,946 | 8/1959 | Lyvers | 123/41.38 |
| 3,042,011 | 7/1962 | Fenton-Smith | 123/50 B |
| 3,999,523 | 12/1976 | Andreen | 123/53 A |
| 4,207,779 | 6/1980 | Papst | 123/197 AB |

FOREIGN PATENT DOCUMENTS

| | | | |
|---|---|---|---|
| 239520 | 9/1925 | France | 123/66 |

*Primary Examiner*—Craig R. Feinberg
*Assistant Examiner*—David A. Okonsky
*Attorney, Agent, or Firm*—Price, Heneveld, Huizenga & Cooper

[57] ABSTRACT

An internal combustion engine having a pair of opposed ignition pistons and a pump element that reciprocates coaxially in opposition to the pistons. A pair of counterbalance arms are linked to the pump element to also reciprocate in opposition to the pistons. A counterbalance linkage includes rocker arms which are pivotally connected to the housing and which are pivotally and slidably connected to the pump element and the pistons. The engine includes a pair of opposed combustion pistons which reciprocate in synchronism with the ignition pistons and a manifold supplies an ignited fuel/air charge from the ignition to the combustion pistons.

22 Claims, 23 Drawing Figures

INTERNAL COMBUSTION ENGINE

BACKGROUND OF THE INVENTION

The present invention relates to an internal combustion engine and particularly, to an opposed piston engine with a unique pre-compression pump.

A unique internal combustion engine is set forth in my U.S. Pat. No. 3,999,523 which discloses an opposed piston engine with two pistons mounted on opposite ends of a piston rod which, in turn, is pivotally coupled to one end of a rocker arm. The rocker arm is coupled to an eccentric drive mechanism and to the engine block by pivot means which allows lineal movement of the rocker arm during operation. This patent also discloses a second set of two opposed ignition pistons mounted at opposite ends of a second piston rod which is interlinked with the rocker arm in order to reciprocate parallel to the first set of pistons. A pair of counterbalance arms are pivotally coupled to the engine block and to both the rocker arm and the ignition piston linkage so that the counterbalance arms reciprocate in opposition to the reciprocation of both sets of pistons. This engine design will produce a relatively high power output while maintaining high efficiency in order to provide good fuel economy and low pollution emissions.

One feature not associated with the engine of my prior U.S. Pat. No. 3,999,523 is that the engine did not provide an independent means for forcing a fuel/air mixture into the combustion chamber associated with the igniter pistons, and therefore, required the ignition pistons to both force the combusted gases from the combustion chamber after ignition and to draw a new charge into the combustion chamber prior to the compression stroke. This method of fueling the combustion chamber will not insure complete exhausting of combusted gases and will reduce the efficiency of drawing in a new charge. Nor did my prior engine utilize joints and connections which allow large assembly tolerances in order to be adaptable to modern assembly line manufacture.

SUMMARY OF THE INVENTION

Engines embodying the present invention include a piston reciprocatably mounted in an engine housing and a pump means for reciprocating within the housing in opposition to the reciprocation of the piston, thus forcing an uncombusted fuel/air charge into the piston cylinder after the piston is withdrawn from the ignition of the previous charge. The engine also includes a combustion piston reciprocatably mounted in the engine housing. An ignited charge from the combustion chamber of the ignition piston is transferred into the combustion chamber of the combustion piston cylinder in order to ignite a compressed charge therein.

In another aspect of the present invention, a counterbalance arm is pivotally coupled to the engine housing and a linkage means links the piston and the pump means to the counterbalance arm for reciprocation generally parallel with but in opposition to the reciprocation of the piston. In a preferred embodiment of the invention, two pistons are mounted at opposite ends of a piston rod and the pump means includes two pumping surfaces which reciprocate together between the pistons.

According to still another aspect of the present invention, couplings of the engine are provided with ball and socket connectors to allow precise and easy alignment during assembly.

The engine of the present invention provides an independent pump means which forces a new fuel and air charge into the igniter combustion chamber also forcing the combusted exhaust gases out of the cylinder. This produces a more efficient fuel supply to the combustion chamber and, therefore, provides a fuller, more efficient combustion of the fuel. Additionally, the rapid assembly of internal combustion engines on modern assembly lines increases the incidence of errors in such assembly resulting in an increase in cost due to quality control measures and defective assemblies. Utilization of the present engine with joints and couplings that provide faster and easier assembly but with precise part alignment reduces assembly costs associated with quality control checks and error correction.

These and other features, objects and advantages will best be understood by reading the following description thereof together with reference to the accompanying drawings in which:

DETAILED DESCRIPTION OF THE PREFERRED EMBODIMENT

Figure 1:
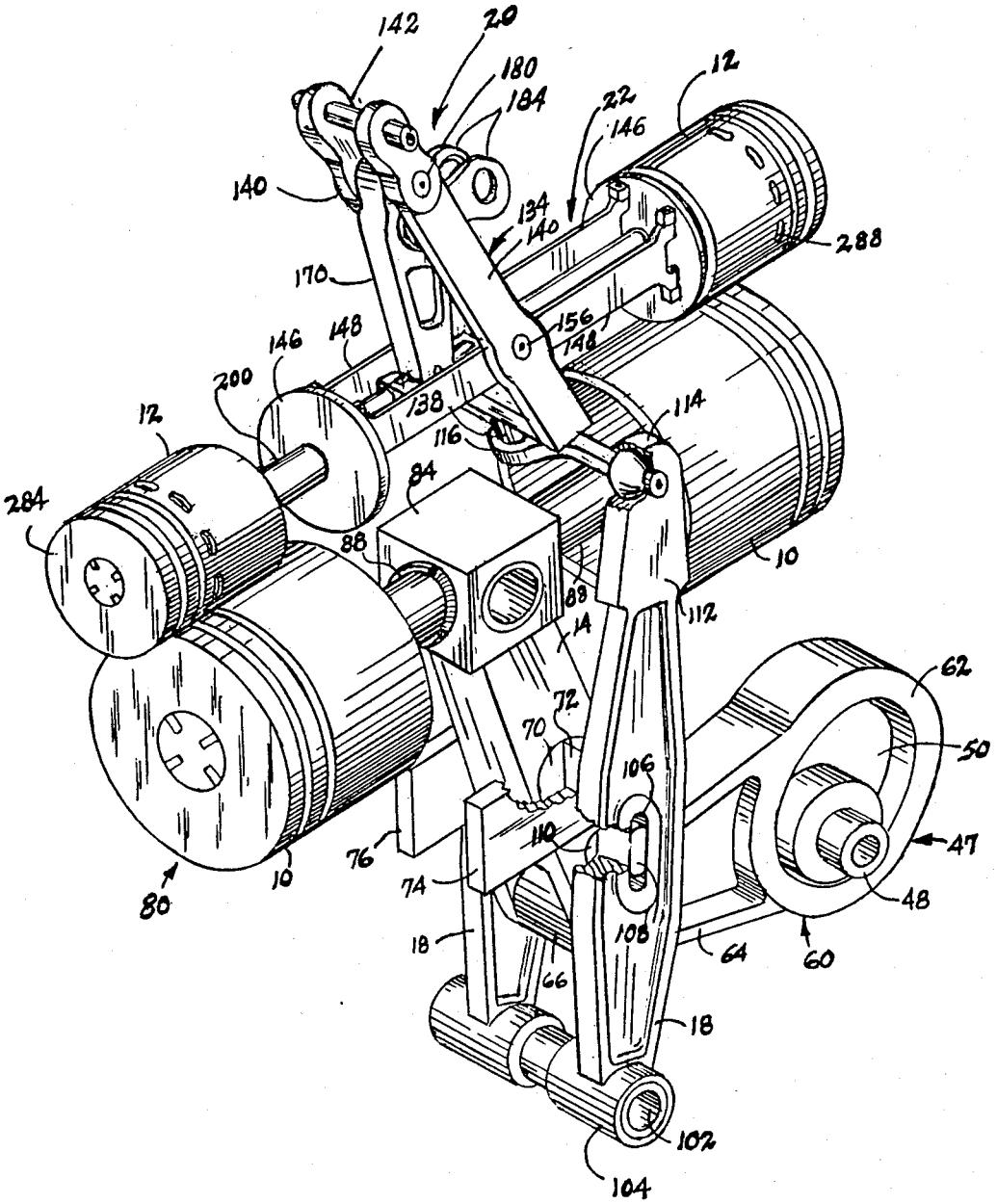
FIG. 1 is a perspective view, partly broken away, of the internal moving elements of a preferred embodiment of the engine of the present invention.
Figure 2:
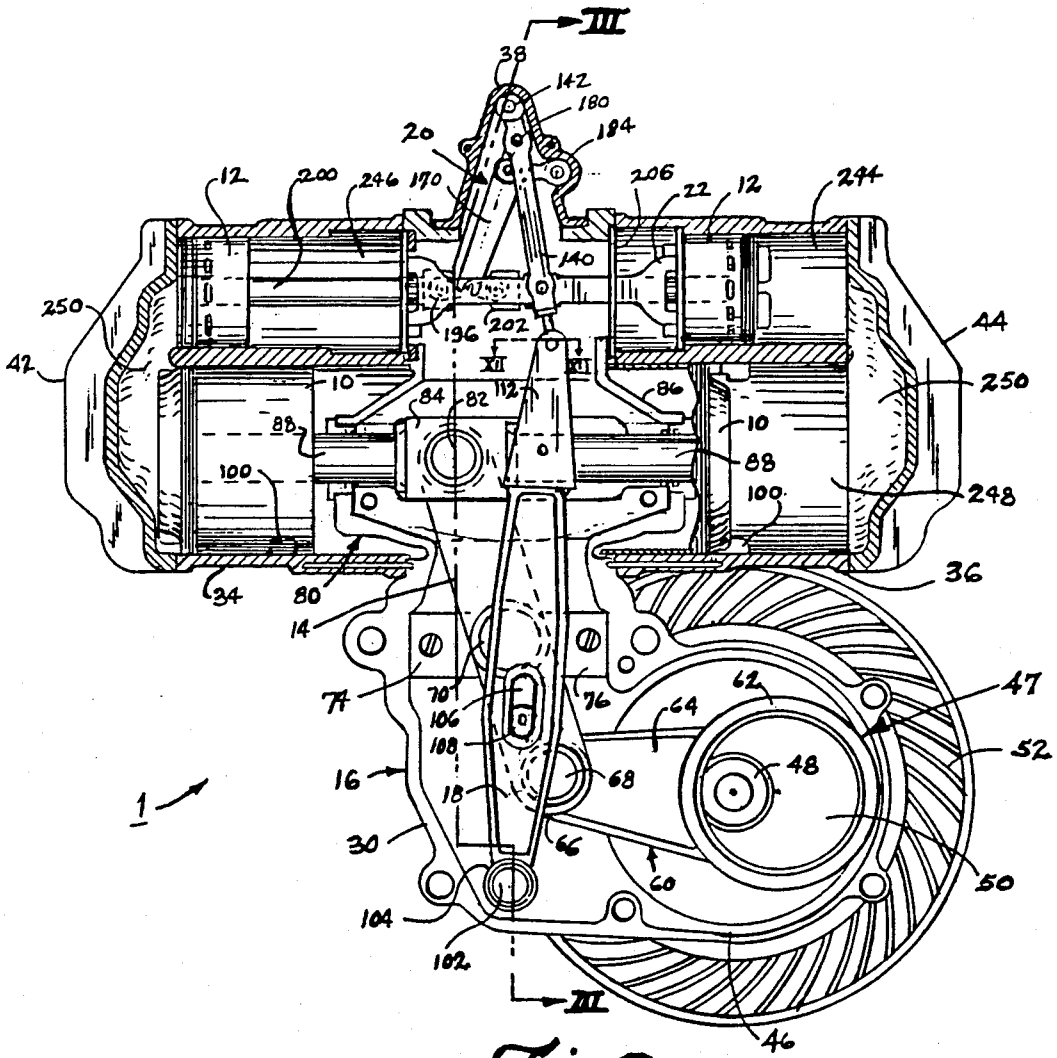
FIG. 2 is a front elevational, sectional view of an engine embodying the present invention shown partly broken away.
Figure 3:
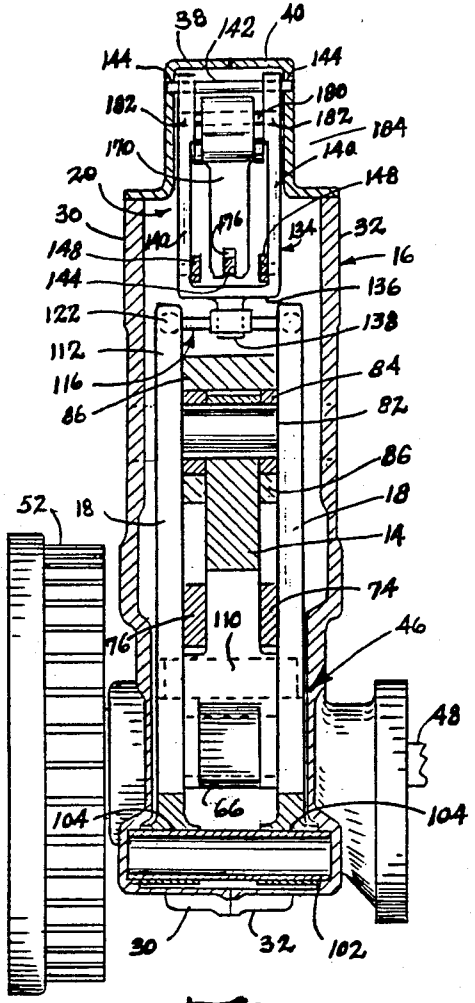
FIG. 3 is a cross section of the engine shown in FIG. 2 taken along section line III—III of FIG. 2.

In the preferred embodiment shown in FIGS. 1–3, an internal combustion engine generally designated by the numeral 1 includes two axially aligned, opposed combustion pistons 10 and a pair of axially aligned, opposed ignition pistons 12 positioned above pistons 10. Pistons 12 reciprocate parallel to and in synchronism with combustion pistons 10. A rocker arm 14 is pivotally mounted to an engine housing 16 in order to reciprocate combustion pistons 10. A pair of counterbalance arms 18 are also pivotally mounted in housing 16 and linked to rocker arm 14 on opposite sides thereof and reciprocate in opposition to rocker arm 14. A linkage assembly 20 links the upper ends of counterbalance arms 18 to the ignition pistons 12. A pump element 22 is axially aligned with each of the ignition pistons 12 and reciprocates between but in oppostion to ignition pistons 12. Linkage assembly 20 also links counterbalance arms 18 to pump element 22.

An internal combustion engine having a set of opposed combustion pistons, opposed ignition pistons and linked rocker arm and counterbalance arms is described in detail in my U.S. Pat. No. 3,999,523, filed May 30, 1975, issued Dec. 28, 1976. My present invention makes numerous unique and non-obvious improvements and modifications on my earlier invention disclosed in U.S. Pat. No. 3,999,523, but many of the subassemblies of the preferred embodiment of the present invention are the same as the description set forth in my earlier patent. Therefore, the disclosure of U.S. Pat. No. 3,999,523 is expressly incorporated herein by reference. Due to the detail of the description of my earlier patent, a detailed description of some subassemblies is not necessary for one skilled in the art to fully understand and practice the present invention. Therefore, a general description of these overlapping subassemblies will be set forth herein along with a detailed description of the various modifications and improvements and a detailed description of their inter-relationship with these overlapping subassemblies.

Referring initially to FIGS. 2 and 3, the air cooled, two-cycle engine 1 of the preferred embodiment includes a left housing 30 and a right housing 32 conventionally secured to one another by bolts. The lower portion of the engine housing, the lower moving parts, typically, being referred to as the block. Attached to the joined left and right housings are a first cylinder housing 34 and a second cylinder housing 36, which are secured to joined housings 30 and 32 also by conventional means including gaskets for sealing the housing sections. Attached to the top of left housing 30 and right housing 32 are a left linkage housing 38 and a right linkage housing 40. Left and right linkage housings are conventionally secured to left and right housings 30 and 32 by bolts and are also conventionally secured to one another by bolts to form a housing enclosure and mounting area for linkage assembly 20. The exterior enclosing portions of the engine are completed by a first cylinder head 42 and a second cylinder head 44 which are respectively secured to first cylinder housing 34 and second cylinder housing 36. Each of the housing members and heads is integrally cast of a suitable material, preferably aluminum or an alloy thereof.

As shown in FIGS. 2 and 3, the lower portions of left and right housings 30 and 32 define a crank case 46 which houses drive assembly 47, including an engine drive shaft 48. Mounted to drive shaft 48 is an eccentric cam 50. Also, secured to drive shaft 48 is a fly wheel 52 and extending through drive shaft 48 is a transmission shaft 54 which is coupled to a suitable transmission assembly (not shown). Drive assembly 47 is set forth in detail in U.S. Pat. No. 3,999,523 including the various bearings, seals and flanges in sufficient detail that repetition is not necessary.

A single connecting rod 60 includes a first end 62 surrounding eccentric cam 50 of drive shaft 48 and a suitable bearing that is interposed between cam 50 and first end 62. The body portion 64 tapers to a second end 66 which is pivotally coupled to rocker arm 14 by means of a connecting rod pin 68. Rocker arm 14 is a single bar which has a clevis at one end for receipt of the second end 66 of rod 60 and the connecting rod pin 68.

Rocker arm 14 is pivotally coupled to the engine housing by means of a rocker arm pivot pin 70 which includes a pair of vertically extending tongues 72 (FIG. 1) on opposite ends thereof which extend into vertical slots (not shown) formed in a pair of rocker pivot pin guides 74 and 76 that are secured within housing sections 30 and 32. This arrangement allows pivot pin 70 to pivot in rocker arm 14 as well as move up and down relative to housings 30, 32 in order to provide a floating pivot point. This permits the required pivotal motion and lineal motion of the rocker arm as it follows the eccentric motion of connecting rod 60 induced by eccentric cam 50.

Figure 7:
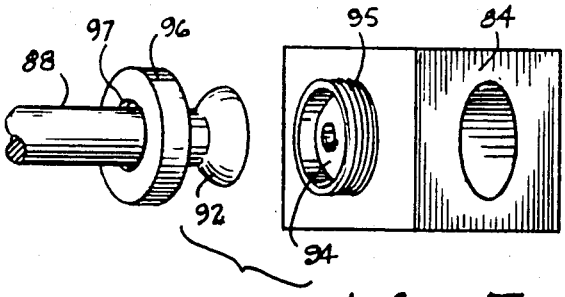
FIG. 7 is an exploded, fragmentary, perspective view of a ball and socket connection for the piston rods of a preferred embodiment of the invention.
Figure 8:
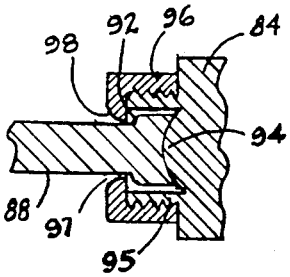
FIG. 8 is an assembled, fragmentary, sectional view of the ball and socket connection shown in FIG. 7.

The upper end of rocker arm 14 is pivotally coupled to combustion piston assembly 80 by means of a pivot pin 82 which forms a pivotal connection with a cross head block 84. As seen in FIG. 3, since rocker arm 14 is a single element, rocker arm 14 extends up through an aperture in a cross head block guide 86 and an aperture in cross head block 84. As shown in FIG. 2, two rods 88 have one end coupled to opposite sides of cross head block 84 so as to extend in opposite directions along a single axis and opposite ends fixedly coupled to hollow pistons 90. Rods 88 are each coupled to cross head block 84 by a ball and socket joint, shown in FIGS. 7 and 8. The one end of each of the rods 88 terminates in a semi-spherical cup or socket 92 that mates with a convex, semi-spherical surface 94 formed on block 84. Extending around surface 94 is a threaded lip 95 that receives an internally threaded circular locking collar 96. Locking collar 96 has an aperture 97 that allows collar 96 to slide over rod 88 prior to assembly to the piston 10 and secures socket 92 within lip 95 and against surface 94. As shown in FIG. 8, aperture 97 has a curved edge 98, so that socket 92 can move slightly on surface 94, and rod 88 will still have clearance through aperture 97. This ball and socket joint provides ease of assembly and alignment of the engine parts without critical tolerances and may be used variously at other joints in the engine.

The remaining details of combustion piston assembly 80 are set forth at length in my earlier U.S. Pat. No. 3,999,523. This combustion piston assembly allows the reciprocatable motion of opposed combustion pistons 10 to be translated by the floating pivotal motion of rocker arm 14 and connecting rod 60 into a rotational motion of drive shaft 48. Combusted gases escape from the engine through a set of exhaust ports 100 (FIG. 2).

Counterbalance arms 18 are pivotally mounted in housing 16 in part to provide counterbalancing for the moving mass of the main engine piston assembly and in part to provide a linking element for ignition pistons and pump element 22, described in detail below. As shown in FIG. 2, counterbalancing arms 18 are pivotally mounted to the engine housing by means of a pivot pin 102 extending through integrally formed sleeves 104 (FIG. 3) at the lower end of counterbalance arms 18 that is seated in housing halves 30, 32 below connecting rod pin 68. Each counterbalance arm 18 includes an elongated, longitudinally extending slot 106 for slidably receiving a tongue 108 of a counterbalance drive pin 110. As shown in FIG. 1, counterbalance drive pin 110 extends through rocker arm 14 and includes a suitable bushing to allow counterbalance drive pin 110 to pivot with respect to rocker arm 14. Counterbalance drive pin tongues 108 extend from either side of pin 110, so that this arrangement provides a floating pivot point between rocker arm 14 and counterbalance arms 18. Drive pin 110 is positioned between connecting rod pin 68 and rocker arm pivot pin 70 so that as rocker arm 14 pivots about pivot pin 70, drive pin 110 causes counterbalance arms 18 to move in a direction opposite to cross head block 84 and pistons 10. This opposed motion, therefore, provides the desired engine counterbalancing effect. Counterbalance arms 18 are positioned on opposite sides of and immediately adjacent to cross head block guide 86 and include enlarged and elongated heads 112 which can be drilled and lead weighted, as required, to increase the counterbalance weight thereof. Counterbalance arms heads 112 are tapered so as to form an elongated triangular configuration, with a top or apex 114 to which is coupled linkage assembly 20, as described more fully below.

As shown in FIGS. 1, 3, 12 and 13, pivotally mounted between heads 112 of counterbalancing arms 18 is a beam 116 which spans the gap between counterbalancing arm heads 112. Beam 116 is used to couple counterbalance arms 18 to the remainder of linkage assembly 20 and, therefore, synchronize the pivoting of arms 18 with ignition pistons 12. Beam 116 has a substantially straight line configuration and includes a central, cylindrical collar 118 from opposite sides of which extend a pair of aligned arms 120. Pivotally mounted on each arm 120 is a spherical ball bushing 122 which has an aperture therethrough so as to be freely slid over the end of arm 120. Arms 120 each end in a seat 123 of narrower diameter than the rest of arm 120. Bushings 122 are seated on seats 123 which prevent bushings 122 from sliding inward. Recessed into the facing surfaces of heads 112 of both counterbalance arms 18 is a semi-spherical socket 124 which rotatably receives spherical ball bushing 122. Collar 118 (FIG. 13) has a cup-shaped body 126 to which a cap 128 is threadedly secured. The interior cup of collar 118 is spherical to movably contain a spherical bushing 130. Extending through the central axis of collar 118 is an aperture 132 which corresponds to an aperture extending through bushing 130, aperture 132 being used to couple beam 116 with the remainder of linkage assembly 20. When beam 116 is pinned between counterbalance arms 18, collar 118 will rotate freely as well as spherical bushing 130 rotating freely within collar 118. This rotation of collar 118 permits the remainder of linkage assembly 20 to remain coupled to beam 116 when counterbalance arms 18 pivot and change the angle of orientation of counterbalance arm heads 112. The movement of spherical ball bushing 122 allows some tolerance in assembling bushing 130 onto the portion of linkage assembly 20 that couples with beam 116.

Figure 12:
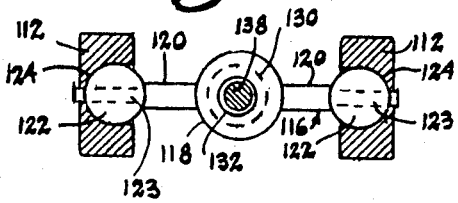
FIG. 12 is a sectional view of the linkage and counterbalance arms taken along section line XII—XII of FIG. 2.

Coupled to straight line beam 116 is a Y-shaped yoke 134, best seen in FIG. 3. Yoke 134 has a base or spacing bar 136 from which depends a central connecting peg 138 and from which upwardly extends a pair of spaced legs 140. Connecting peg 138 is cylindrically shaped and is received through aperture 132 and bushing 130 to extend through collar 118 and, thereby, couple yoke 134 to beam 116. As shown in FIG. 12, aperture 132 is slightly greater than the diameter of peg 138 so that connecting peg 138 can pivot and rotate to some degree without interference from body 126 or cap 128. Peg 138 also extends some distance below collar 118, so that as yoke 134 pivots back and forth, collar 118 with bushing 130 can slide up and down on peg 138. This movement allows peg 138 to remain coupled in collar 118 while counterbalance arms 18 reciprocate through their vertical arc. Yoke legs 140 are pivotally mounted to left and right linkage housing 38 and 40 by a pivot pin 142 (FIG. 3) which extends through the top of legs 140 and is received into a pair of seats 144 in linkage housing 38, 40. Suitable bushings are provided to allow yoke 134 to freely pivot about pivot pin 142 as counterbalance arms 18 reciprocate back and forth, while the collar 118-peg 138 coupling allows counterbalance arm head 112 and the tops of yoke legs 140 to shift closer together as arms 18 and yoke 134 pivot.

Figure 4:
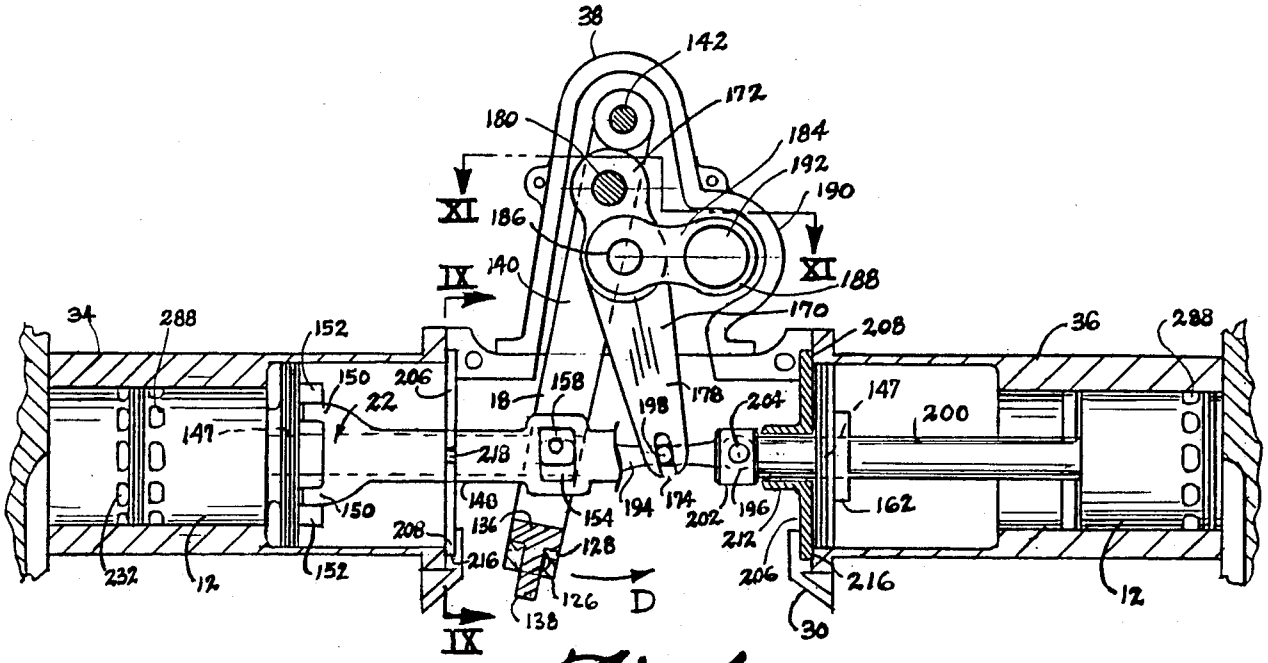
FIG. 4 is a fragmentary, front elevational, sectional view, partly broken away, of the ignition pistons, pump surfaces and linkage of a preferred embodiment of the engine of the present invention.
Figure 5:
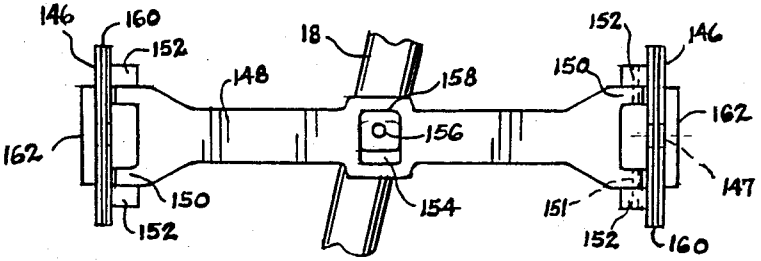
FIG. 5 is a fragmentary, front elevational view of the linkage connection with the pump means of FIG. 4.

As shown in FIG. 4, pump element 22 reciprocates between ignition pistons 12 and is used to force a new fuel/air charge into the combustion chambers associated with ignition pistons 12 and includes a pair of spaced, generally annular pump surfaces 146. Pump surfaces 146 are mounted on a pair of spaced reciprocator rods or bars 148 (FIGS. 1 and 5). Reciprocator bars 148 each have a fork at each end that terminates in two prongs 150. Extending rearward from the non-working surface of each pump surface 146 are four pivot blocks 152 that are spaced in groups of two to allow one of the forked ends of each of the reciprocating bars 148 to be pivotally coupled between a pair of pivot blocks 152.

Each pivot block 152 is pivotally mounted to a prong 150 by a suitable pivot pin 151 (FIG. 5) so that, when assembled, pump surfaces 146 can pivot a slight amount relative to reciprocating bars 148. This movement provides a tolerance facilitating assembly of pump element 146.

In order to reciprocate pumping pistons or surfaces 146, reciprocator bars 148 are mounted on yoke legs 140 to reciprocate lineally as yoke legs 140 pivot. To translate the arcuate motion of yoke legs 140 into lineal movement, a vertically oriented slot 154 with a rectangular cross section passes through the enlarged midpoint of each reciprocating bar 148, FIGS. 4 and 5. A pivot pin 156 pivotally mounted a rectangular bushing 158 on the facing surface of each yoke leg 140. Each rectangular bushing 158 is received in a slot 154 which allows bushings 158 to slide up and down on reciprocating bars 148. When assembled, reciprocating bars 148 are held between yoke legs 140, as seen in FIGS. 1 and 3, and the pivotal and slidable connect about pivot pin 156 allows reciprocating bars 148 to reciprocate in the same horizontal plane as yoke 134 is pivoted back and forth driven by counterbalancing arms 18.

Pump surfaces 146 are generally disc shaped and have an integral annular groove 160 around their outer periphery for seating an appropriate ring or seal to create a close fitting seal with the cylinder wall 34, 36. The diameter of pump surfaces 146 is greater than the diameter of ignition pistons 12 so that the fuel/air charge pumped by surfaces 146 will be compressed when it is forced into the cylinders associated with ignition pistons 12. The working faces of pump surfaces 146 each have a circular disc-shaped collar or ring 162 screwed into its center that encircle an aperture 147. Collar 162 holds a set of seals in a seat around aperture 147, each aperture 147 allowing the rod for ignition piston 12 to pass in coaxial alignment through pump surface 146. Collar 162 holds two conventional seals, one for sealing against a vacuum, and the other for sealing against a raised pressure so that pump surface 146 will remain sealed throughout its entire stroke, as explained below.

Pivotally mounted between yoke legs 140 is an ignition piston rocker arm 170 (FIGS. 1–4) which has an enlarged top end 172 and a pair of orthogonal slots 174 and 176 which extend up into the lower end 178 of rocker arm 170. Slot 174 extends through rocker arm 170 from front to back (FIG. 4), and slot 176 extends through rocker arm 170 from side to side (FIG. 3). As best seen in FIGS. 3 and 4, a pivot pin 180 passes through enlarged top end 172 of rocker arm 170 and is seated in seats 182 in both yoke legs 140. Pivot pin 180 includes suitable bushings to allow rocker arm 170 to pivot freely relative to the upper ends of yoke legs 140. Pivot pin 180 is located fairly close to yoke pivot pin 142 so that the moment pin between yoke pivot pin 142 and pivot pin 180 is much shorter than the moment arm between pivot pin 142 and yoke base 136.

Pivotally connected to the upper end 172 of arm 170, below pivot pin 180, are a pair of parallel extending, horizontally spaced toggle links 184 (FIGS. 1 and 4). The opposite ends of each toggle link is pivotally coupled to the engine housings 38 and 40 by a pivot pin 192 and bushing. A toggle link 184 is coupled on either side of rocker arm 170 with a pivot pin 186 extending through toggle links 184 and through rocker arm 170. Pivot pin 186 has suitable bushings which allow toggle links 184 to freely pivot relative to rocker arm 170. Toggle links 184 are configured in a figure eight shape, and both have an extending arm 188 which extends from the same side of rocker arm 170. As shown in FIG. 4, linkage housing sections 38 and 39 have an outwardly curved sidewall portion 190 which is located adjacent extending ends 188 to prevent interference therewith. A pivot pin 192 is seated between left and right linkage housing sections 38 and 40 and extends through extending ends 188. Pivot pin 192 has suitable bushings to allow toggle links 184 to pivot freely relative to linkage housing 38, 40.

With the above arrangement, it will be recognized that as yoke 134 is pivoted relative to linkage housing 38, 40 in one direction, lower end 178 of rocker arm 170 will pivot in the opposite direction relative to linkage housing 38, 40. Toggle links 184 provide the required floating pivot point 186 about which rocker arm 170 pivots burt which also allows the necessary vertical movement of rocker arm 170 and pivot pin 180. This floating pivot point is necessary since ignition piston rocker arm 170 is carried on yoke legs 140 and, therefore, shifts vertically as yoke legs 140 pivot through their arcuate path. Toggle links provide this floating pivot point with a small number of moving parts that are easily manufactured and assembled.

Figure 11:
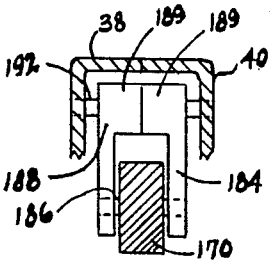
FIG. 11 is a fragmentary, sectional view of the ignition piston rocker arm-housing linkage taken along section line XI—XI of FIG. 4.

In another preferred embodiment, shown in FIG. 11, toggle links 184 are replaced by a single toggle 189 with a bifurcated end spanning arm 170. The opposite end of toggle 189 provides a greater pivot surface contacting pivot pin 192 and, therefore, reduces the chances of failure of the toggle connection of arm 170 to the engine housing.

Pivotally and slidably coupled to lower end 178 of rocker arm 170 is an ignition piston coupling 194 which couples ignition pistons 12 with rocker arm 170. As shown in phantom, in FIGS. 2 and 4, coupling 194 is a connecting rod configured in a figure eight shape, having an aperture through both ends 196 that act as a pivot pin seat. Extending from either side of the center portion of coupling 194 is a circular peg 198, FIG. 4. Pegs 198 are sized to be received in slot 174 when coupling 194 is slid into rocker arm lower end 178, while ends 196 simultaneously protrude out through slot 176. Slots 174, 176 and peg 198 allow coupling 194 to pivot and to also slide up and down relative to rocker arm 170. This pivotal sliding movement is necessary for the reciprocation of pistons 12, as described below.

Ignition pistons 12 each have a rod 200 with an end coupled to ignition piston 12 by a ball and socket coupling of the type shown in FIG. 8 and described above. These couplings allow pistons 12 to move slightly relative to rods 200 and, therefore, allows tolerance for assembly. The ends of rods 200, opposite pistons 12, each integrally include a clevis 202 which fit over ends 196 of coupling 194 (FIG. 4). A pin 204 pivotally couples each clevis to coupling 194, and also allows tolerance during assembly of rods 200. Rods 200 pass through the central aperture 147 in pump surfaces 146 and are engaged by the seals on pump surfaces 146 so that each pump element 22 will form a pumping chamber behind each ignition piston 12. Since coupling 194 both slides and pivots, the arcuate motion of rocker arm 170 as it pivots is translated into lineal reciprocation of pistons 12 in cylinder housings 34 and 36.

Figure 6:
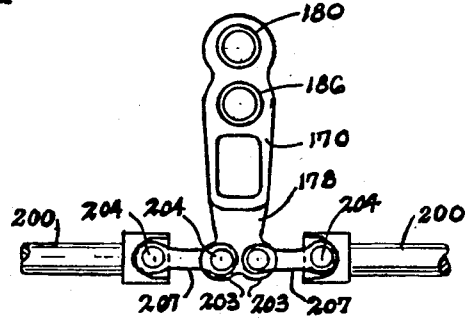
FIG. 6 is a fragmentary, front elevational view of another embodiment of the linkage connection for the piston rods shown in FIG. 4.

In another preferred embodiment, shown in FIG. 6, ignition piston rocker arm 170 does not include slots 174 and 176 at its lower end 178. Instead, rocker arm 170 has at its lower end a pair of pivot seats 203. A pair of toggle links 207 are pivotally pinned on either side of each rod 200 and rocker arm lower end 178 by pivot pins 204. Thus, neither rods 200 nor rocker arm 170 are required to terminate in a clevis, yet the same pivotal, slidable motion is provided. The manufacture of rocker arm 170 is, therefore, simplified since slots 174 and 176 are not required.

Figure 9:
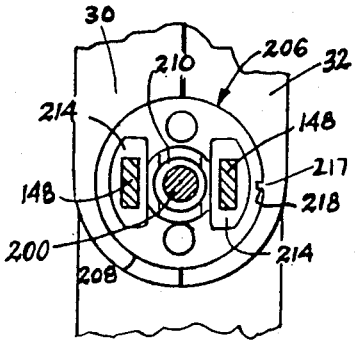
FIG. 9 is a sectional view of the piston rod guide, piston rod and pump activating arms taken along section line IX—IX of FIG. 4.
Figure 10:
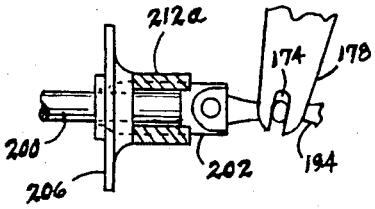
FIG. 10 is a fragmentary, front elevational view, partly sectioned, of a linkage connecting the piston rod and piston rod guide embodying an alternative preferred embodiment of the present invention.
Figure 13:
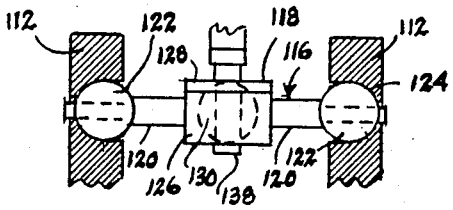
FIG. 13 is a fragmentary, side elevational, sectional view of the linkage of the counterbalance arms of FIG. 12.

A piston rod guide 206 (FIG. 9) is located at the connecting end of each cylinder housing 34, 36 between left and right housings 30 and 32, FIG. 4. Piston rod guides 206 guide the lineal movement of piston rods 200 without interfering with the reciprocation of pump element 22. Each guide 206 has a circular perimeter 208 and an aperture 210 for receiving rod 200. As shown in FIG. 4, extending away from the piston facing side of guide 206 around aperture 210 is a sleeve 212 which slidingly guides rod 200. As shown in FIG. 9, located on either side of aperture 210 is a roughly rectangular slot 214 that provides openings through which pump bars 148 can pass without contacting guide 206. As shown in FIG. 4, perimeter 208 is fitted in an annular groove 216 that is formed between the ignition piston portion of housing 16 and clyinder housings 34, 36. On one side of annular groove 216 is a rectangular tab 217 which is received in a notch 218 (FIG. 9) to position guide 206 and prevent its rotation after it has been clamped between housings 30, 32 and cylinder housings 34, 36.

As shown in FIG. 4, sleeve 212 extends from each guide 206 but terminates at a point removed from the furthest point of travel of clevis 202. In an alternate preferred embodiment of FIG. 9, a portion of a sleeve 212*a* has a larger aperture and so is radially spaced sufficiently from rod 200 that clevis 202 can reciprocate within sleeve 212*a*. Sleeve 212*a*, therefore, guides clevis 20 at the end and start of a stroke.

Figure 18:
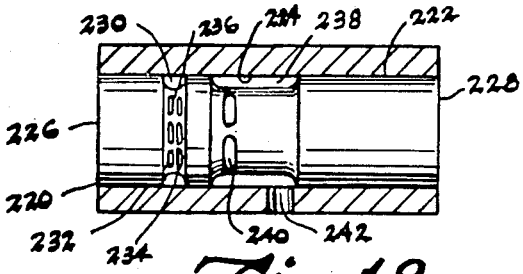
FIG. 18 is a vertical, cross-sectional view of an engine housing cylinder showing a piston sleeve therein.

As shown in FIG. 18, located in the ignition piston portion of each cylinder housing 34 and 36 is a piston sleeve 220 in which piston 12 reciprocates and a pump sleeve 222 in which pump surface 146 reciprocates. Each cylinder housing 34 and 36 defines a cylindrical chamber 224 into which sleeves 220 and 222 are fitted.

Piston sleeve 220 has a combustion end 226 and a pump end 228. Extending about the circumference of sleeve 222 is an annular groove 230 that is used to channel the fuel/air charge into the combustion chamber ahead of piston 12, as described below. Spaced about the circumference of sleeve 220 and annular groove 230 are two parallel rings of ports 232 and 234, respectively. Adjacent each port 232 is a complimentary port 234 separated by a spacer 236. Ports 232 and 234 are also utilized in transferring a fuel charge into the combustion chamber ahead of piston 12. Located between annular groove 230 and pump end 228, on the outside of sleeve 220, is an elongated annular groove 238 that is used to channel a new fuel/air charge into the pumping chamber ahead of pump face 146. Spaced about sleeve 220 in annular groove 238 are inlet ports 240 which extend through sleeve 220. Passing through each cylinder housing 34, 36 is an inlet 242 which is communicative with a suitable intake manifold. A unique manifold system suitable for use with my present engine is described in detail in my earlier U.S. Pat. No. 3,999,523. This system includes an integral manifold that serves both as the intake and exhaust manifold and allows the preheating and the complete vaporization of fuel as well as protecting the housing from hot exhaust gases. This manifold couples with both inlets 242 and exhaust ports 100, as described in that Patent.

Figure 19:
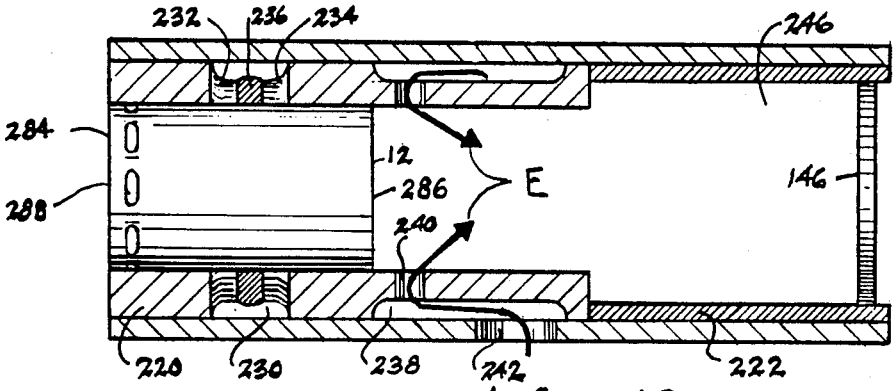
FIG. 19 is a schematic sequence drawing showing the ignition piston, cylinder sleeve and housing of the preferred embodiment of the invention in a first position during a cycle of operation.
Figure 20:
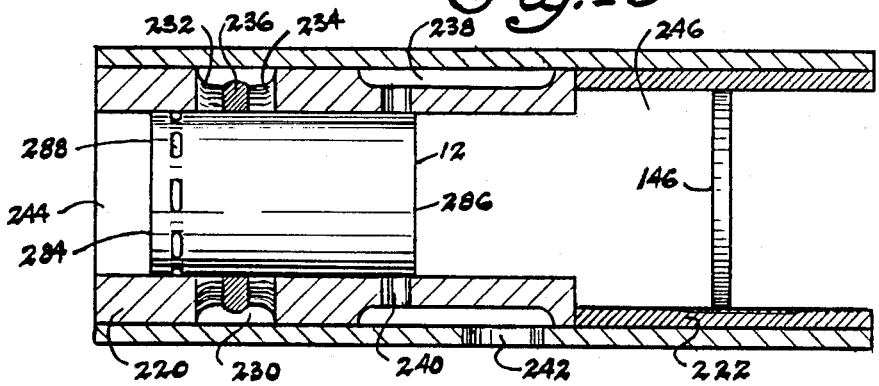
FIG. 20 is a schematic sequence drawing showing the ignition piston, cylinder sleeve and housing of the preferred embodiment of the invention in a second position during a cycle of operation.
Figure 21:
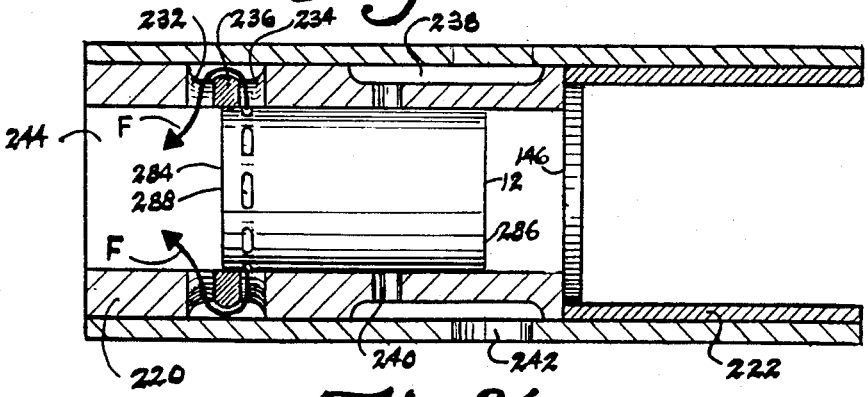
FIG. 21 is a schematic sequence drawing showing the ignition piston, cylinder sleeve and housing of the preferred embodiment of the invention in a third position during a cycle of operation.

As shown in FIGS. 19–21, pump sleeve 222 abuts piston sleeve 220 and has an inside diameter greater than that of piston sleeve 220 so that a new fuel/air charge will be compressed when it is transferred to the combustion chamber associated with piston 12. Sleeve 222 has a substantially smooth, cylindrical interior surface in order to provide a good seal with rings 160 on pump surfaces 146.

As shown in FIG. 2, cylinder housings 34, 36 and sleeve 220 form an ignition piston combustion chamber 244 ahead of ignition pistons 12. A pump chamber 246 is formed in sleeve 222 ahead of pump surfaces 146. A main combustion chamber 248 is formed in both cylinder housings 34 and 36 ahead of combustion pistons 10. Ignition piston combustion chamber 244 and main combustion chamber 248 are linked by a transfer chamber 250. A rich fuel mixture can be introduced into ignition piston chamber 244, compressed and ignited by a spark plug (not shown). Transfer chamber 250 then allows the ignited rich fuel/air mixture to flame into main combustion chamber 248. Due to the flaming action of ignition chamber 244, a much leaner fuel/air mixture can be introduced into main combustion chamber 248, and efficient burning will still be produced. A direct oiling system is also preferably included in housing 16, such oiling system being fully described in my earlier U.S. Pat. No. 3,999,523. A series of interlinked channels are included throughout housing 30, 32, cylinder housings 34 and 36 and linkage housing 38, 40. Oil is introduced through these channels to be deposited on various joints, as well as passing into complimentary channels on the moving elements for transportation to other oiling locations. Preferably, porous brass sections are included at areas of high wear through which the oil is transmitted.

Figure 23:
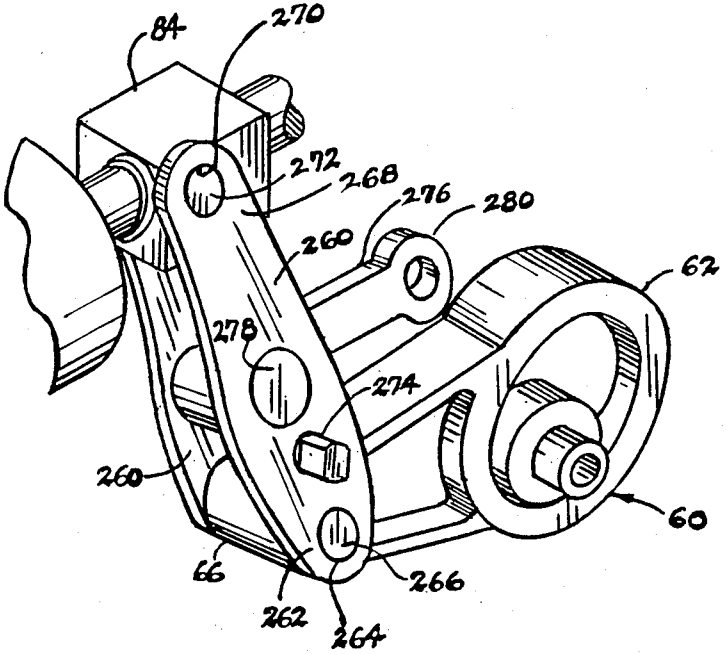
FIG. 23 is a fragmentary, perspective view of the rocker arm and rocker arm housing connector of FIG. 22.
Figure 22:
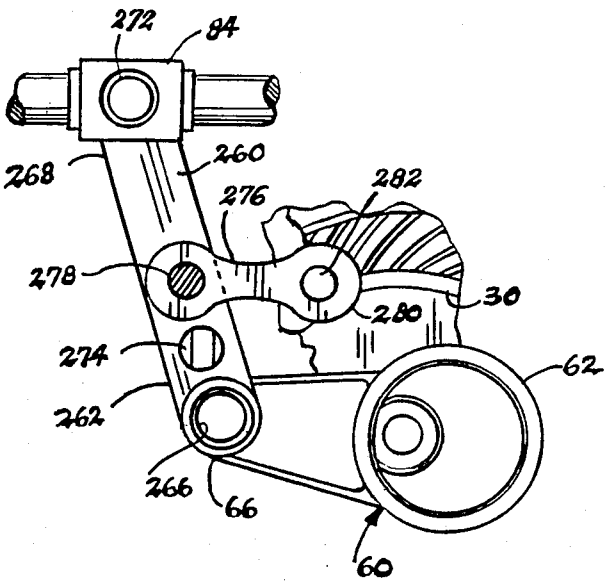
FIG. 22 is a fragmentary, front elevational view of a rocker arm and rocker arm housing connector of an alternative preferred embodiment of the invention.

Another preferred embodiment of my invention is shown in FIGS. 22, 23. Instead of a single rocker arm being used to reciprocate cross head block 84 and, therefore, combustion pistons 10, a pair of spaced rocker arm plates 260 are used. Each rocker arm plate has an aperture 264 through lower end 262 and a connecting rod pin 266 pivotally connects rocker arm plates 260 on either side of end 66 of connecting rod 60. Rocker arm plates 260 have an upper end 268 with an aperture 270 for receiving a pivot pin 272, which extends through cross head block 84 and pivotally connects rocker arm plates 260 on either side of cross head block 84. A counterbalance drive pin 274 with tongues that extend from either side extends between rocker arm plates 260 at a location between connecting rod pin 266 and pivot pin 272. Counterbalance drive pin 274 mates with slots 106, as described above, to provide the required floating pivot point necessary to reciprocate counterbalance arms 18. Since two plates 260 are used, instead of a single rocker arm 14, cross head block 84 is not required to be slotted and, therefore, is easier to manufacture. Also, since plates 260 pass on either side of cross head block 84 and end 66 of rod 60, plates 260 do not require a clevis at their base. Rocker plates 260, therefore, provide relatively easy manufacture and assembly.

A toggle link 276 that couples rocker plates 260 to housing 30, 32 is pivotally connected between plates 260 by a pivot pin 278. Pivot pin 278 has a suitable bushing to allow toggle link 276 to pivot freely between rocker arm plates 260. Toggle link 276 has an extending end 280 which extends to the side of plates 260, toward connecting rod first end 62. Extending end 280 is pivotally mounted between left and right housings 30, 32 by pivot pin 282 and has suitable bushings to allow extending end 280 to freely pivot on the housing. This freely pivoting coupling allows toggle link 276 to provide a floating pivot point for rocker plates 260 in order to permit upper end 268 to reciprocate forward and backward as lower end 262 is reciprocated by connecting rod 60.

Having described the detailed construction of the engine and its various features, a description of a cycle of operation of the engine is now presented in connection with FIGS. 14–17.

OPERATION

In the preferred embodiment, a pair of opposed, larger combustion pistons and a pair of opposed, smaller ignition pistons reciprocate in unison while the counterbalance arms and the pump surfaces aligned coaxially with the ignition pistons reciprocate in opposition to the combustion pistons and ignition pistons. This embodiment allows a pump element to draw a new charge of fuel/air mixture into a pumping chamber as the ignition piston compresses and combusts an earlier charge, and then forces the new charge into the combustion chamber ahead of the ignition pistons, thus, forcing the combusted exhaust gases out of the ignition piston combustion chambers.

Figure 14:
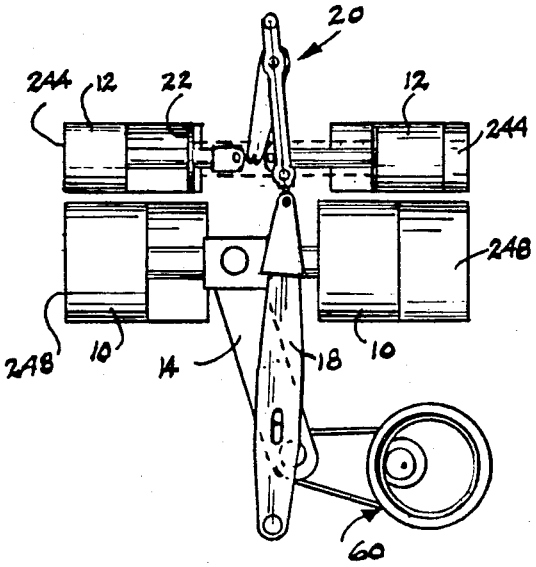
FIG. 14 is a schematic sequence drawing showing the positioning of the primary movable elements of the preferred embodiment of the invention in a first position during a cycle of operation.
Figure 15:
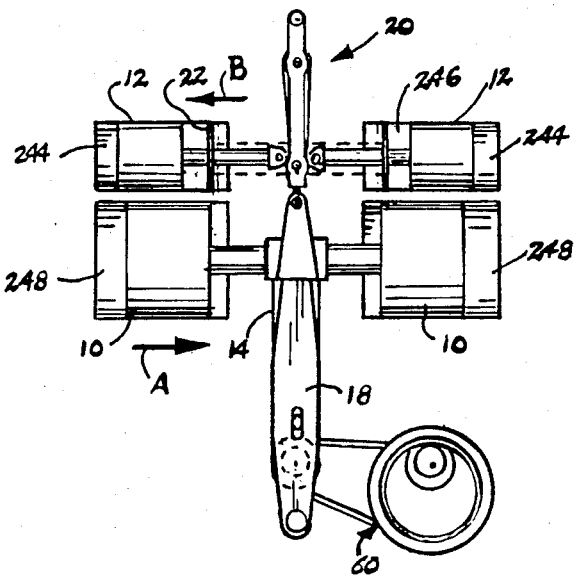
FIG. 15 is a schematic sequence drawing showing the positioning of the primary movable elements of the preferred embodiment of the invention in a second position during a cycle of operation.

As shown in FIG. 14, both combustion and ignition pistons 10 and 12 have moved all the way to the left end of their stroke. At the same time, pump element 22 has moved all the way to the right end of its stroke and has drawn in a new charge of fuel/air. The fuel/air mixture in ignition chamber 244 on the left side is sparked, which ignites and flames into combustion chamber 248. This combustion causes pistons 10 and 12 to move to the right, as indicated by arrow A in FIG. 15. Simultaneously, pump element 22 begins moving toward the left, as depicted by arrow B in FIG. 15, to compress the new charge of fuel/air mixture for the left ignition piston while simultaneously drawing a new fuel/air mixture into pump chamber 246 for the right ignition piston.

Figure 16:
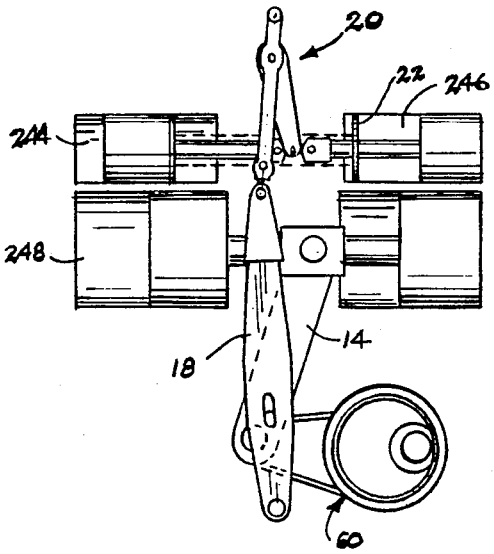
FIG. 16 is a schematic sequence drawing showing the positioning of the primary movable elements of the preferred embodiment of the invention in a third position during a cycle of operation.
Figure 17:
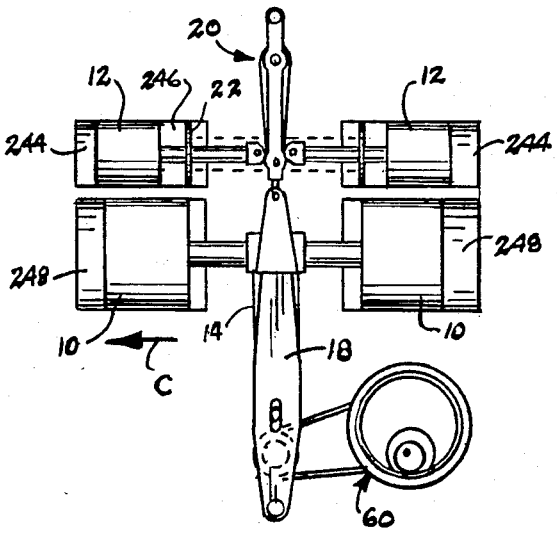
FIG. 17 is a schematic sequence drawing showing the positioning of the primary movable elements of the preferred embodiment of the invention in a fourth position during a cycle of operation.

As shown in FIG. 16, pistons 10 and 12 have reached the end of their stroke, fully extended to the right, while pump element 22 has moved to the end of its stroke, fully extended to the left. The new charge of fuel/air mixture has been forced into ignition combustion chamber 244 for the left ignition piston 12 while the ignition combustion 244 for the right ignition piston is simultaneously being sparked to ignite. As shown in FIG. 17, pistons 10 and 12 are then moving to the left in the direction of arrow C, while pump element 22 simultaneously moves to the right.

As shown with more detail in Figs. 1 and 4, as collar 118 is moved by counterbalance arms 18, in the direction of arrow D, collar 118 and pivot pin 138 also move generally to the right, thereby moving pump element 22 to the right. As collar 118 moves to the right, yoke legs 140 pivot enlarged top end 172 of rocker arm 170 to the right also. Since rocker arm 170 is held at floating pivot 186, lower end 178 moves generally to the left with the pivoting of top end 172 to the right, as shown in FIG. 4, thereby shifting rods 200 and pistons 12 to the left in opposition to pump element 22.

Depicted in FIGS. 19–21 is a cycle of an ignition piston 12 and a pump surface 146 that shows the valving arrangement utilized with ignition combustion chamber 244 and pump chamber 246. As shown in FIG. 17, piston 12 is extended to the firing end of its stroke, while pump surface 146 has retreated to the furthest position away from piston 12 at the intake end of its stroke. Piston 12 has a head end 284 and a skirt end 286. Spaced around the perimeter of piston 12 near end 284 are a series of piston ports 288 which pass through to the inside of hollow piston 12. In the firing position, as shown in FIG. 17, ports 288 are adjacent the closed sides of sleeve 220, while the sides of piston 12 are adjacent to and seal ports 232 and 234 so that the gases are not allowed to pass through ports 232, 234. Skirt end 286 has moved past inlet port 240 so that a new charge of fuel/air mixture is drawn into pump chamber 246 through ports 240 and 242, as shown by arrow E, due to the vacuum caused by receeding pump surface 146, as explained below. As shown in FIG. 20, after the charge compressed in combustion chamber 244 is fired, piston 12 begins to receed while pump surface 146 simultaneously begins moving forward toward piston 12. The skirt end 286 of piston 12 passes inlet port 240, sealing it to prevent the fuel/air mixture in pump chamber 246 from escaping. As piston 12 and pump surface 146 continue toward one another, the new charge is compressed between these two elements. When piston ports 288 align with ports 232 through sleeve 222, ports 234 are still closed by the side of piston 12 so that no gases pass through ports 288.

As shown in FIG. 21, when piston 12 is fully withdrawn and pump surface 146 is fully extended forward toward piston 12, the head 284 becomes aligned with spacers 236 through sleeve 222. Ports 288 are now aligned with ports 234 so that the compressed fuel/air mixture in pump chamber 246 can pass through ports 288 around through ports 234 and 232 into ignition combustion chamber 244, as shown by arrows F. This forces any remaining combusted exhaust gases out of chamber 244.

As a new cycle begins, piston 12 and pump surface 146 move away from each other from the close relationship of FIG. 21 to the firing position of FIG. 19. Pump surface 146 withdraws away from piston 12 and induces a vacuum in pump chamber 246 behind advancing piston 12, drawing a new fuel/air charge into pump chamber 246.

The coaxial pump, ignition-piston arrangement described above solves problems encountered by most two-cycle engines. Normally, a two-cycle engine piston must operate to both draw in a new charge of fuel/air and also to expell combusted exhaust gases. This dual function reduces the efficiency of the piston in both drawing in the new charge and also in fully expelling the exhausted gases. Hence, the preferred embodiment provides a pair of opposed pistons which operate in unison to translate the combustion into a useful rotational motion while the pump independently supplies the fuel to the combustion chamber. The coaxial alignment of the pump and ignition pistons produces a compact, economical design that has the beneficial feature of the pump element 22 acting in part as a counterbalance to the moving mass of pistons 12.

It is not necesssary that the above pump-piston arrangement be used in an engine having two sets of parallel, reciprocating pistons. The utilization of a smaller ignition piston to fully ignite the main combustion piston increases fuel efficiency while reducing pollutants, but the ignition pistons could be utilized as main combustion pistons as well. The engine could be constructed to only include a single set of opposed pistons, or in an engine that provides both sets of pistons, the fuel supply to the main combustion pistons could be shut off when so desired. In an engine incorporating a single set of pistons, rod 60 could pivotally and slidably connect to either counterbalance arms 18 or to beam 116 directly, instead of through rocker arm 14.

It will be recognized that the various sliding pivotal joints provided by the preferred embodiment, such as the connection of yoke 134 with pump bars 148, collar 118, piston coupling 194 and the like allow the required range of movement for the joints but also increase the manufacturing tolerances of the engine. For instance, the ball and socket connection of the piston rods allow the piston rods to be slightly misaligned during assembly, yet the engine will operate. Such increased tolerances not only improve the reliability of the engine after assembly, but reduce the costs associated with the manufacture and assembly of the engine.

It will be understood by those skilled in the art that various of the features of the preferred embodiment of the present invention can be employed independent of the overall engine forming the preferred embodiment. Thus, for example, the unique pump linkage may be utilized in an engine of a different design. The various unique couplings and sliding pivots can be incorporated in other existing machines. The unique cylinder sleeve-valve arrangement may be used in other two-cycle engines. Further, it will be apparent to one skilled in the art that a second engine of identical design can be incorporated into the engine housing to increase the number of pistons and thus, increase the power as required.

It is to be understood that the above is a description of the preferred embodiment and that various other improvements or modifications of the invention can be made without departing from the spirit of the concept disclosed herein. The scope of the invention is to be determined by the claims which follow and the breadth of interpretation that the law allows.

The embodiments of the invention in which an exclusive property or privilege is claimed are defined as follows:

1. An internal combustion engine comprising:

an engine housing having a first piston cylinder;

a first piston mounted for reciprocation in said first cylinder;

counterbalance arm means pivotally coupled to said housing for pivotal movement and for counterbalancing said first piston, said counterbalancing arm means including a counterbalance head;

a first pump means for reciprocating within said housing in opposition to said first piston for forcing an uncombusted charge into said first cylinder after said first piston has withdrawn from the ignition of a previous charge; and linkage means for coupling said first piston to said counterbalance arm for reciprocation by said pivotal movement of said counterbalance arm and for coupling said first pump means to said counterbalance arm means for reciprocation by said pivotal movement of said counterbalance arm, such that said pump means and said counterbalance head reciprocate in opposition to the reciprocation of said first piston.

2. An engine as defined in claim 1 and further comprising:

a drive shaft rotatably mounted to said housing and including eccentric drive means; and a connecting rod having one end coupled to said eccentric drive means and the other end linked to said counterbalance arm means, whereby pivotal reciprocation of said counterbalance arm means is translated by said connecting rod and eccentric drive means into rotational motion of said drive shaft.

3. The engine as defined in claim 2 and further comprising:

a second cylinder and a second piston coaxially aligned with said first piston and mounted in said second cylinder to reciprocate with said first piston; and a second pump means for reciprocating within said housing in opposition to said second piston for forcing an uncombusted charge into said second cylinder after the second piston has withdrawn from the ignition of a previous charge.

4. An internal combustion engine comprising:

an engine housing including an ignition cylinder and a combustion cylinder;

a first combustion piston reciprocatably mounted within said combustion cylinder;

a first ignition piston reciprocatably mounted within said ignition cylinder;

means for transferring an ignited charge from said ignition cylinder into said combustion cylinder to ignite a compressed charge in the combustion cylinder;

pump means within said ignition cylinder including a pump element moving in opposition to the reciprocation of said ignition piston for forcing an uncombusted charge into said ignition cylinder after said ignition piston has withdrawn from the ignition of a previously charge, said pump element being mounted within said ignition cylinder to reciprocate coaxially with said first ignition piston;

a second ignition piston coaxially aligned with said first ignition piston, said pump means being reciprocatably mounted between said first and second ignition pistons and reciprocating in opposition to said first and second ignition pistons;

a second combustion piston coaxially aligned with said first combustion piston;

lever means pivotally mounted on said housing and coupled to said pump means for reciprocating said pump means; and combustion piston reciprocating means coupled to said lever means and to said combustion pistons for reciprocatably pivoting said lever means.

5. The engine as defined in claim 4 wherein said pump element is disk-shaped and has a diameter greater than the diameter of said ignition piston.

6. The engine as defined in claim 5 wherein said housing includes an ignition piston cylinder sleeve mounted in said ignition cylinder, said sleeve including ports formed therein to allow the introduction of an uncombusted charge into the ignition cylinder combustion chamber.

7. An internal combustion engine comprising:

an engine housing having a first piston cylinder;

a first piston mounted for reciprocation in said first cylinder;

counterbalance arm means pivotally coupled to said housing for counterbalancing said first piston including a counterbalance head;

a first pump means for reciprocating within said housing in opposition to said first piston for forcing an uncombusted charge into said first cylinder after said first piston has withdrawn from the ignition of a previous charge;

linkage means coupling said first piston and said first pump means to said counterbalance arm means such that said pump means and said counterbalance head reciprocate in opposition to the reciprocation of said first piston;

a drive shaft rotatably mounted to said housing and including eccentric drive means;

a connecting rod having one end coupled to said eccentric drive means and an opposite end linked to said counterbalance arm means, whereby pivotal reciprocation of said counterbalance arm means is translated by said connecting rod and eccentric drive means into rotational motion of said drive shaft;

a second cylinder and a second piston coaxially aligned with said first piston and mounted in said second cylinder to reciprocate with said first piston;

a second pump means for reciprocating within said housing in opposition to said second piston for forcing an uncombusted charge into said cylinder after the second piston has withdrawn from the ignition of a previous charge; and said first pump means including a first pump element and said second pump means including a second pump element, said first and second pump elements being linked together and coaxially aligned with each other and with said first and second pistons, said first and second pump elements mounted in said housing to reciprocate between said first and second pistons.

8. The engine as defined in claim 10 and further comprising:

combustion cylinder means formed in said housing;

a pair of coaxially aligned combustion pistons having a diameter larger than the diameter of said first and second pistons, said combustion pistons being reciprocatably mounted in said combustion cylinder means; and a rocker arm coupled to said first and second pistons, said rocker arm being pivotally coupled to said counterbalance arm means, whereby said counterbalance arm means pivot in opposition to said rocker arm.

9. An internal combustion engine comprising:

an engine housing defining an ignition cylinder and a combustion cylinder;

a first combustion piston reciprocatably mounted within said combustion cylinder;

a first ignition piston reciprocatably mounted within said ignition cylinder;

means for transferring an ignited charge from said ignition cylinder into said combustion cylinder to ignite a compressed charge in the combustion cylinder;

pump means within said ignition cylinder and including a pump element moving in opposition to the reciprocation of said ignition piston for forcing an uncombusted charge into said ignition cylinder after said ignition piston has withdrawn from the ignition of a previous charge;

lever means pivotally mounted on said housing for reciprocating said pump means; and means coupled to said combustion piston and to said lever means for reciprocating said lever means.

10. The engine as defined in claim 9 wherein said pump element has a diameter greater than the diameter of said ignition piston.

11. The engine as defined in claim 9 and further including an ignition piston cylinder sleeve mounted in said ignition cylinder, said sleeve including ports formed therein to allow the introduction of an uncombusted charge into the ignition cylinder.

12. An internal combustion engine comprising:

an engine housing including a first cylinder;

a first piston coupled to a first piston rod for reciprocation in said first cylinder;

a first pump element coupled to a first reciprocating rod for reciprocating said pump element in said first cylinder;

a first rocker arm pivotally mounted and first pivot means mounting said first rocker arm to said housing, said first reciprocating rod pivotally mounted to said first rocker arm by a second pivot means spaced from said first pivot means;

a second rocker arm pivotally mounted at one end to said first rocker arm by third pivot means disposed between said first and second pivot means, said first piston rod being pivotally mounted to said second rocker arm by fourth pivot means spaced from said third pivot means;

a linking element pivotally mounted to said housing at one end and pivotally mounted at an opposite end to said second rocker arm by fifth pivot means disposed between and permitting translational as well as pivotal movement of said fifth pivot means, said third pivot means and said fourth pivot means;

first translational means for moving said second pivot means toward and away from said first pivot means; and second translational means for moving said fourth pivot means toward and away from said third pivot means, whereby said first piston and said first pump surface reciprocate parallel to and in opposition to each other.

13. An engine as defined in claim 12 wherein said housing includes a second cylinder and further comprising:

a second piston coupled to a second piston rod for reciprocation in said second cylinder, said second piston rod being pivotally mounted to said second rocker arm by said fourth pivot means to be coaxially aligned with but opposed to said first piston; and said pump element having a second pump element coupled to a second reciprocating rod for reciprocating said second pump element in said second cylinder, said second reciprocating rod being pivotally mounted to said first rocker arm by said second pivot means to be coaxially aligned with but opposed to said first pump element.

14. An engine as defined in claim 13 wherein said first rocker arm includes two substantially parallel legs and said second rocker arm is positioned between said legs.

15. An engine as defined in claim 14 wherein said first and second translational means position said second and fourth pivot means in substantially the same horizontal plane.

16. An engine as defined in claim 15 wherein said first reciprocating rod includes a pair of spaced pump bars for coupling said first and second pump surfaces together and means for pivotally and translationally coupling said pump bars to said parallel legs.

17. An engine as defined in claim 16 wherein said pump elements each have an aperture formed therethrough and wherein said first piston rod extends through said aperture in said first pump element and said second piston rod extends through said aperture in said second pump element.

18. An engine as defined in claim 17 and further comprising a pair of spaced counterbalance arms pivotally mounted to said engine housing; and counterbalance arm coupling means for pivotally and slidably coupling said counterbalance arms to said parallel legs.

19. An engine as defined in claim 18 wherein said counterbalance coupling means includes a first portion joining said legs and a bar extending from said first portion, a counterbalance coupling bar extending between said counterbalance arms and slidably coupled to said extending bar.

20. An internal combustion engine comprising:

an engine housing defining first and second cylinders;

a first and second piston reciprocatably mounted within said first and second cylinders;

a first yoke linked to said first piston and a second yoke linked to said second piston, each yoke having one end pivotally mounted in said housing to pivotally reciprocate with the reciprocation of said pistons, said yokes extending generally toward one another;

means for coupling together the ends of said first and second yokes opposite said one ends for a sliding, pivotal coupling interlinking said first and second pistons; and said first yoke including a first pair of legs and said second yoke including a second pair of legs, said coupling means including a crossbar having an aperture therethrough rotatably secured between said first legs and a sliding bar secured between said second legs, said sliding bar being generally aligned with said second legs and slidably received in said crossbar aperture.

21. The engine defined in claim 20 wherein said first yoke is pivotally coupled to one end of a first piston rocker arm and said second yoke is pivotally coupled to one end of a second piston rocker arm, said first and second rocker arms being linked to said housing intermediate the ends of said rocker arms so that said rocker arms pivot in synchronization with but in opposition to said yokes.

22. The engine defined in claim 21 wherein said housing defines third and fourth cylinders; and a third and a fourth piston reciprocatably mounted within said third and fourth cylinders, said third piston aligned with said first piston but extending opposite therefrom, said fourth piston aligned with said second piston but extending opposite therefrom, said first and third pistons being substantially parallel to said second and fourth pistons.

* * * * *

UNITED STATES PATENT AND TRADEMARK OFFICE

CERTIFICATE OF CORRECTION

PATENT NO. : 4,516,539

DATED : May 14, 1985

INVENTOR(S) : John F. Andreen

It is certified that error appears in the above-identified patent and that said Letters Patent is hereby corrected as shown below:

Column 5, line 59:
"arms" should be --arm--

Column 6, line 53:
"head" should be --heads--

Column 7, line 14:
"mounted" should be --mounts--

Column 7, line 55:
"pin" (first occurrence) should be --arm--

Column 8, line 17:
"burt" should be --but--

Column 9, line 35:
"20" should be --202--

Column 14, claim 4, line 35:
"previously" should be --previous--

UNITED STATES PATENT AND TRADEMARK OFFICE

CERTIFICATE OF CORRECTION

PATENT NO. : 4,516,539

DATED : May 14, 1985

INVENTOR(S) : John F. Andreen

It is certified that error appears in the above-identified patent and that said Letters Patent is hereby corrected as shown below:

Column 15, claim 8, line 35:
"10" should be --7--

Signed and Sealed this

*Third* Day of *December 1985*

[SEAL]

*Attest:*

DONALD J. QUIGG

*Attesting Officer*

*Commissioner of Patents and Trademarks*